US007358455B2

(12) United States Patent
Schaltenbrand et al.

(10) Patent No.: US 7,358,455 B2
(45) Date of Patent: Apr. 15, 2008

(54) CRADLE STOP ASSEMBLY, AND OPERATING MECHANISM AND ELECTRICAL SWITCHING APPARATUS EMPLOYING THE SAME

(75) Inventors: Brian J. Schaltenbrand, Cranberry Township, PA (US); Robert W. Mueller, Aliquippa, PA (US); Mark A. Janusek, Pittsburgh, PA (US); William G. Eberts, Coraopolis, PA (US); Keith E. Thomas, Burgettstown, PA (US)

(73) Assignee: Eaton Corporation, Cleveland, OH (US)

( * ) Notice: Subject to any disclaimer, the term of this patent is extended or adjusted under 35 U.S.C. 154(b) by 67 days.

(21) Appl. No.: 11/466,273

(22) Filed: Aug. 22, 2006

(65) Prior Publication Data

US 2008/0047812 A1 Feb. 28, 2008

(51) Int. Cl.
*H01H 23/00* (2006.01)

(52) U.S. Cl. ..... 200/401; 200/400

(58) Field of Classification Search ..... 200/400, 200/401, 433, 337; 218/14, 18, 20, 21, 153; 335/156, 132, 15, 203
See application file for complete search history.

(56) References Cited

U.S. PATENT DOCUMENTS 5,260,533 A * 11/1993 Livesey et al. ..... 200/401
5,266,760 A * 11/1993 Link et al. ..... 200/244
5,302,788 A * 4/1994 Link et al. ..... 200/401
5,910,760 A 6/1999 Malingowski et al.
5,938,008 A 8/1999 Wehrli, III et al.
6,005,206 A 12/1999 Rakus et al.
6,803,536 B1 * 10/2004 Slepian ..... 200/400
6,812,423 B1 * 11/2004 Rodgers et al. ..... 200/400
6,870,115 B1 * 3/2005 Slepian ..... 200/401

OTHER PUBLICATIONS

U.S. Appl. No. 11/035,309, filed Jan. 13, 2005, Rakus et al.
U.S. Appl. No. 11/411,601, filed Apr. 26, 2006, Schaltenbrand.
U.S. Appl. No. 11/436,336, filed May 18, 2006, Schaltenbrand.

* cited by examiner

*Primary Examiner*—Elvin Enad
*Assistant Examiner*—Lisa Klaus
(74) *Attorney, Agent, or Firm*—Martin J. Moran

(57) ABSTRACT

A cradle stop assembly is provided for a circuit breaker including an operating mechanism. The operating mechanism includes a pivotable movable contact arm and a cradle member which is movable between a latched position corresponding to separable contacts of the circuit breaker being closeable and an unlatched position corresponding to the separable contacts being tripped open. The cradle stop assembly includes a first member coupled to a portion of the operating mechanism, a second member disposed opposite the first member, and a generally planar stop plate extending between the first and second members. A first stop portion of the stop plate resists movement of the cradle member beyond a first predetermined position to avoid the cradle member undesirably interfering with the pivotable movable contact arm. A second stop portion resists the pivotable movable contact arm from undesirably pivoting beyond a second predetermined position.

21 Claims, 5 Drawing Sheets

CRADLE STOP ASSEMBLY, AND OPERATING MECHANISM AND ELECTRICAL SWITCHING APPARATUS EMPLOYING THE SAME

BACKGROUND OF THE INVENTION

1. Field of the Invention

The invention relates generally to electrical switching apparatus and, more particularly, to cradle stop assemblies for electrical switching apparatus, such as circuit breakers. The invention also relates to operating mechanisms for electrical switching apparatus. The invention further relates to electrical switching apparatus employing cradle stop assemblies.

2. Background Information

Electrical switching apparatus, such as circuit breakers, provide protection for electrical systems from electrical fault conditions such as, for example, current overloads, short circuits, and other fault conditions.

As shown in FIG. 1, circuit breakers such as 2 typically include a housing 4, separable electrical contacts 6,8 enclosed by the housing 4, and a spring powered operating mechanism 10 which opens the electrical contacts to interrupt the current through the conductors of an electrical system in response to electrical fault conditions. The electrical contacts 6,8 generally comprise one or more movable contacts 6 and one or more corresponding stationary contacts 8. Each movable contact 6 is disposed at or about a first end 12 of a spring-biased movable contact aim 14. The spring-biased movable contact arm 14 is pivotably coupled, at or about its second end 16, to a crossbar 18 of the operating mechanism 10. The crossbar 18 carries the movable contact arms 14 for all of the poles 20 (one pole 20 is shown) of the circuit breaker 2, and cooperates with a cradle 22 of the circuit breaker operating mechanism 10 to allow for simultaneous opening and closing of the contacts 6,8 in all of the poles 20.

The operating mechanism 10 controls the spring-biased movable contact arm 14 to pivot the movable contact 6 into and out of electrical contact with the corresponding stationary contact 8. A contact arm spring 24 biases the second end 16 of the movable contact arm 14, proximate the operating mechanism crossbar 18, in order to maintain the closed position (shown in phantom line drawing) of the pair of movable and stationary contacts 6,8. A cradle stop pin 26 stops cradle 22 at the desired position and prevents it from undesirably over-rotating (e.g., in the counterclockwise direction, from the perspective of FIG. 1) and, for example, interfering with the movable contact arm 14.

The cradle stop pin 26 suffers from a unique set of disadvantages. Among them, is the fact that the movable contact arm 14 of the circuit breaker contact assembly sometimes strikes the pin 26 during operation (e.g., when the circuit breaker is turned OFF; when the circuit breaker trips open) of the circuit breaker 2, which can cause one or both of the contact arm 14 and the pin 26 to bend and/or break. Also, the movable contact arm 14 sometimes undesirably arcs with the cradle stop pin 26 during interruption, thereby causing poor circuit breaker performance and/or failure to clear the electrical fault.

In an attempt to overcome the foregoing disadvantages, one prior proposal has been to notch the cradle stop pin with a cut-out which is structured to provide clearance for the movable contact arm of the circuit breaker contact assembly. However, while the notch cut-out accommodates movement of the movable contact arm, it undesirably reduces the strength of the cradle stop pin. It is also much more difficult and costly to manufacture than the conventional (i.e., unnotched) cradle stop pin.

There is, therefore, room for improvement in cradle stop assemblies for the operating mechanisms of electrical switching apparatus, such as circuit breakers.

SUMMARY OF THE INVENTION

These needs and others are met by embodiments of the invention which are directed to a cradle stop assembly for the operating mechanism of electrical switching apparatus such as, for example, circuit breakers.

As one aspect of the invention, a cradle stop assembly is provided for an electrical switching apparatus. The electrical switching apparatus includes a housing, separable contacts enclosed by the housing, and an operating mechanism for opening and closing the separable contacts. The operating mechanism includes a pivotable movable contact arm, and a cradle member which is movable between a latched position corresponding to the separable contacts being closeable and an unlatched position corresponding to the separable contacts being tripped open. The cradle stop assembly comprises: a first member structured to be coupled to a portion of the operating mechanism of the electrical switching apparatus; a second member disposed opposite the first member; and a stop plate extending between the first member and the second member, such stop plate being generally planar and including a first stop portion and a second stop portion disposed generally opposite the first stop portion, wherein the first stop portion of the stop plate is structured to resist movement of the cradle member beyond a first predetermined position, in order to avoid the cradle member undesirably interfering with the pivotable movable contact arm of the operating mechanism, and wherein the second stop portion of the stop plate is structured to resist the pivotable movable contact arm of the operating mechanism from undesirably pivoting beyond a second predetermined position.

The operating mechanism may further include a crossbar, wherein the pivotable movable contact arm is pivotably coupled to the crossbar, and wherein at least the first member of the cradle stop assembly is structured to be coupled to the crossbar of the operating mechanism. The first member and the second member of the cradle stop assembly may each comprise a generally planar member including a number of apertures, and the stop plate may include a first end having at least one first protrusion and a second end having at least one second protrusion, wherein the first protrusion of the first end of the stop plate engages a corresponding one of the apertures of the first generally planar member and the second protrusion of the second end of the stop plate engages a corresponding one of the apertures of the second generally planar member.

The second stop portion of the stop plate may further comprise a resilient bumper, and the pivotable movable contact arm of the operating mechanism of the electrical switching apparatus may be movable among a closed position corresponding to the separable contacts of the electrical switching apparatus being closed, and an open position corresponding to the separable contacts being separated. When the pivotable movable contact arm is disposed in the open position, the pivotable movable contact arm may be spaced from the stop plate in order to form a gap therebetween, and the resilient bumper may be disposed within the gap. The gap may be about 0.125 inch.

As another aspect of the invention, an operating mechanism is provided for an electrical switching apparatus including a housing and separable contacts enclosed by the housing. The operating mechanism comprises: at least one pivotable movable contact arm carrying at least one of the separable contacts; a cradle member movable between a latched position corresponding to the separable contacts being closeable and an unlatched position corresponding to the separable contacts being tripped open; and a cradle stop assembly comprising: a first member coupled to a portion of the operating mechanism, a second member disposed opposite the first member, a stop plate extending between the first member and the second member, such stop plate being generally planar and including a first stop portion and a second stop portion disposed generally opposite the first stop portion, wherein the first stop portion of the stop plate resists movement of the cradle member beyond a first predetermined position, in order to avoid the cradle member undesirably interfering with the at least one pivotable movable contact arm of the operating mechanism, and wherein the second stop portion of the stop plate resists the pivotable movable contact arm of the operating mechanism from undesirably pivoting beyond a second predetermined position.

The cradle stop assembly may further comprise a barrier member and a coupling member, wherein the barrier member comprises a first end disposed proximate the stop plate, a second end disposed distal from the first end, and an elongated slot extending from the second end of the barrier member and structured to receive the pivotable movable contact arm of the operating mechanism. The barrier member may be disposed between the cradle member of the operating mechanism and the separable contacts of the electrical switching apparatus, wherein the coupling member couples the barrier member to the first and second members of the cradle stop assembly. The coupling member may include a first side coupled to the first member of the cradle stop assembly and a second side coupled to the second member of the cradle stop assembly in order that the barrier member and the elongated slot thereof are disposed between the first side of the coupling member and the second side of the coupling member.

As another aspect of the invention, an electrical switching apparatus comprises: a housing; separable contacts enclosed by the housing; and an operating mechanism for opening and closing the separable contacts, the operating mechanism comprising: at least one pivotable movable contact arm carrying at least one of the separable contacts, at least one cradle member movable between a latched position corresponding to the separable contacts being closeable and an unlatched position corresponding to the separable contacts being tripped open in response to an electrical fault, and at least one cradle stop assembly comprising: a first member coupled to a portion of the operating mechanism, a second member disposed opposite the first member, a stop plate extending between the first member and the second member, such stop plate being generally planar and including a first stop portion and a second stop portion disposed generally opposite the first stop portion, wherein the first stop portion of the stop plate resists movement of the cradle member beyond a first predetermined position, in order to avoid the cradle member undesirably interfering with the at least one pivotable movable contact arm of the operating mechanism, and wherein the second stop portion of the stop plate resists the pivotable movable contact arm of the operating mechanism from undesirably pivoting beyond a second predetermined position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
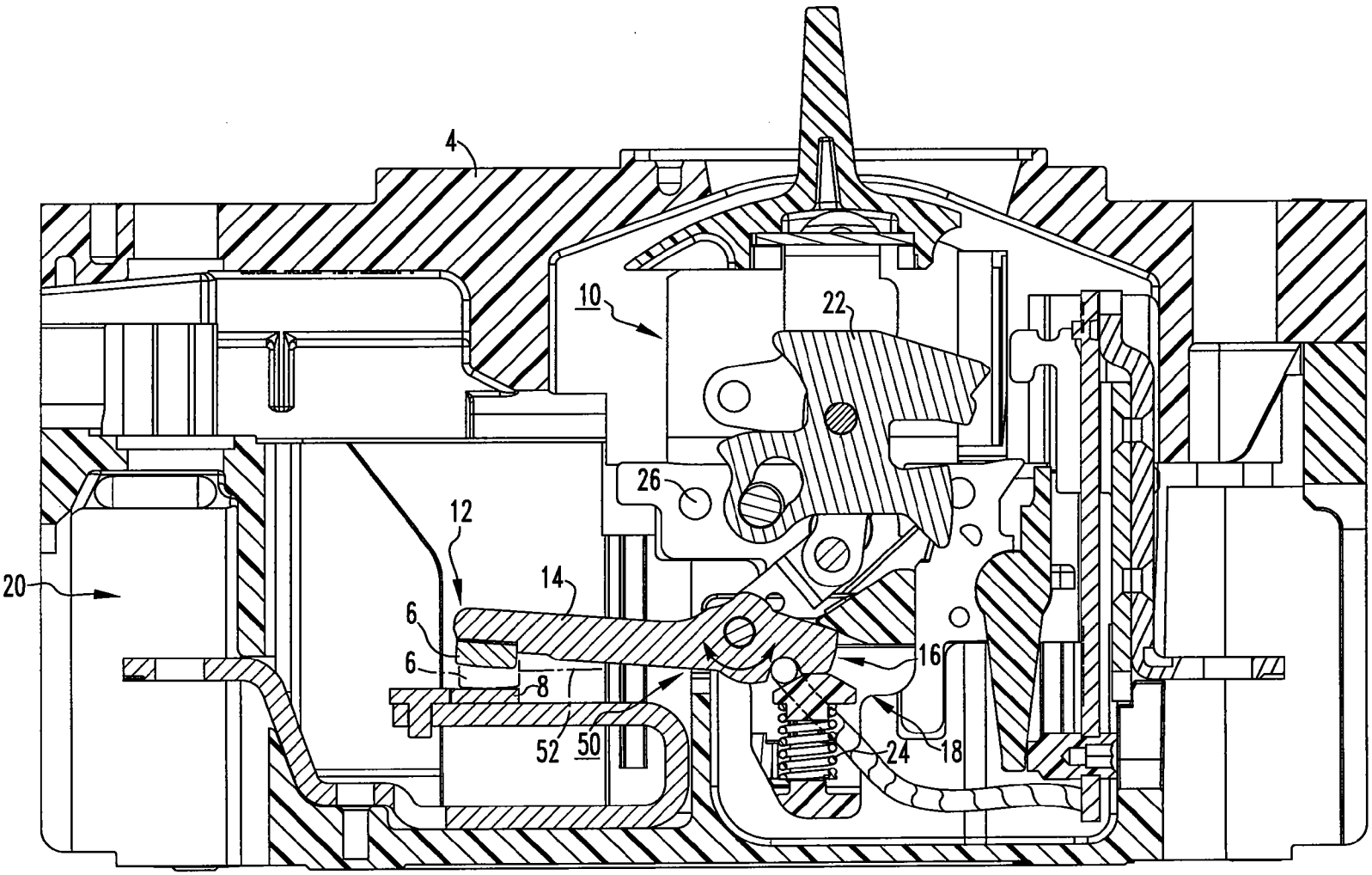
FIG. 1 PRIOR ART
FIG. 1 is a side, cross-sectional view of a circuit breaker, and contact assembly and operating mechanism therefor.

For purposes of illustration, embodiments of the invention will be described as applied to a cradle stop assembly for improving the interruption performance of a circuit breaker, although it will become apparent that they could also be applied to improve interruption performance of any known or suitable electrical switching apparatus (e.g., without limitation, circuit switching devices and circuit interrupters such as circuit breakers, contactors, motor starters, motor controllers and other load controllers).

Directional phrases used herein, such as, for example, top, bottom, front, back, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
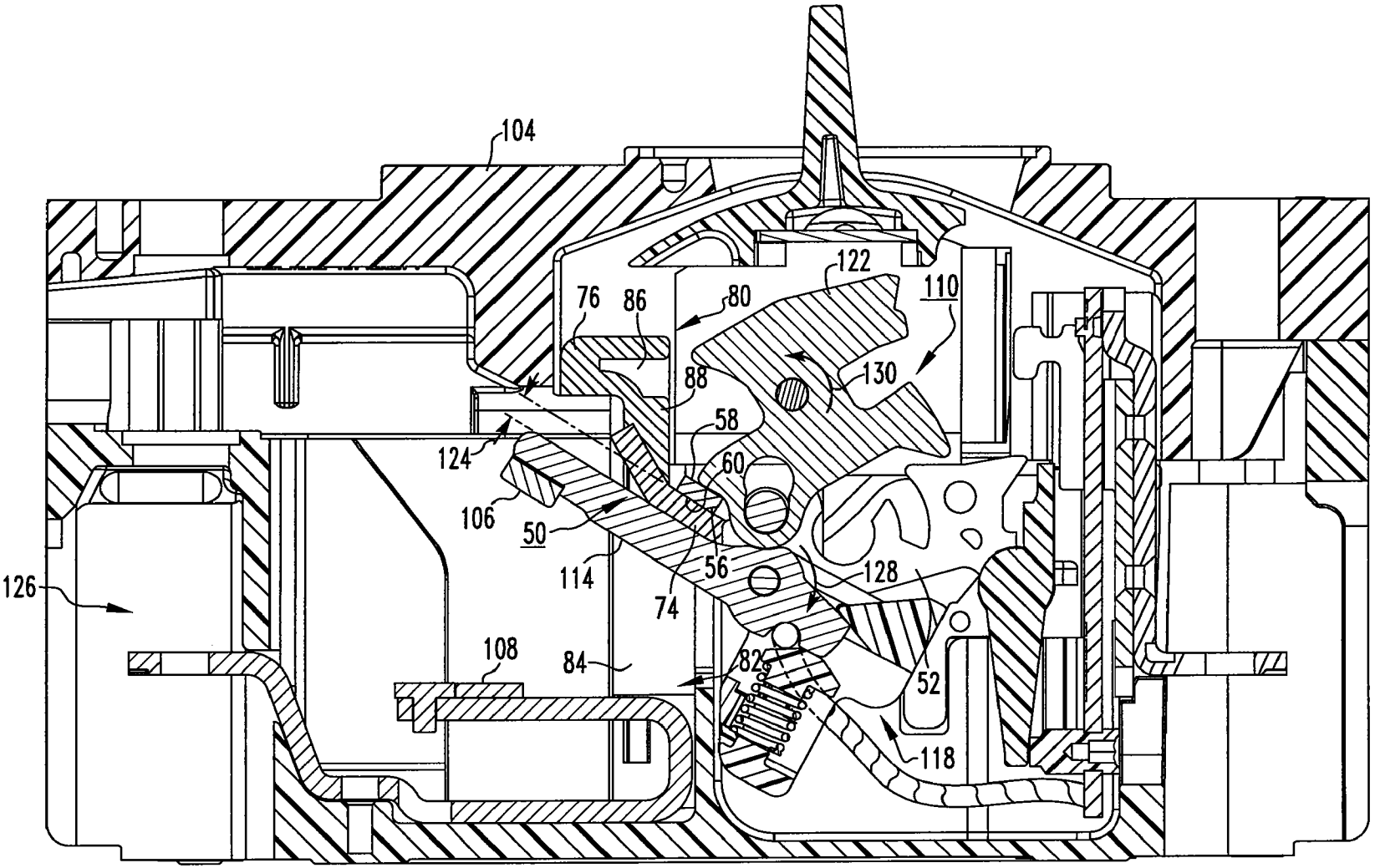
FIG. 2 is a side, cross-sectional view of a circuit breaker, and a contact assembly and a portion of the operating mechanism, including a cradle stop assembly therefor, in accordance with an embodiment of the invention.
Figure 3:
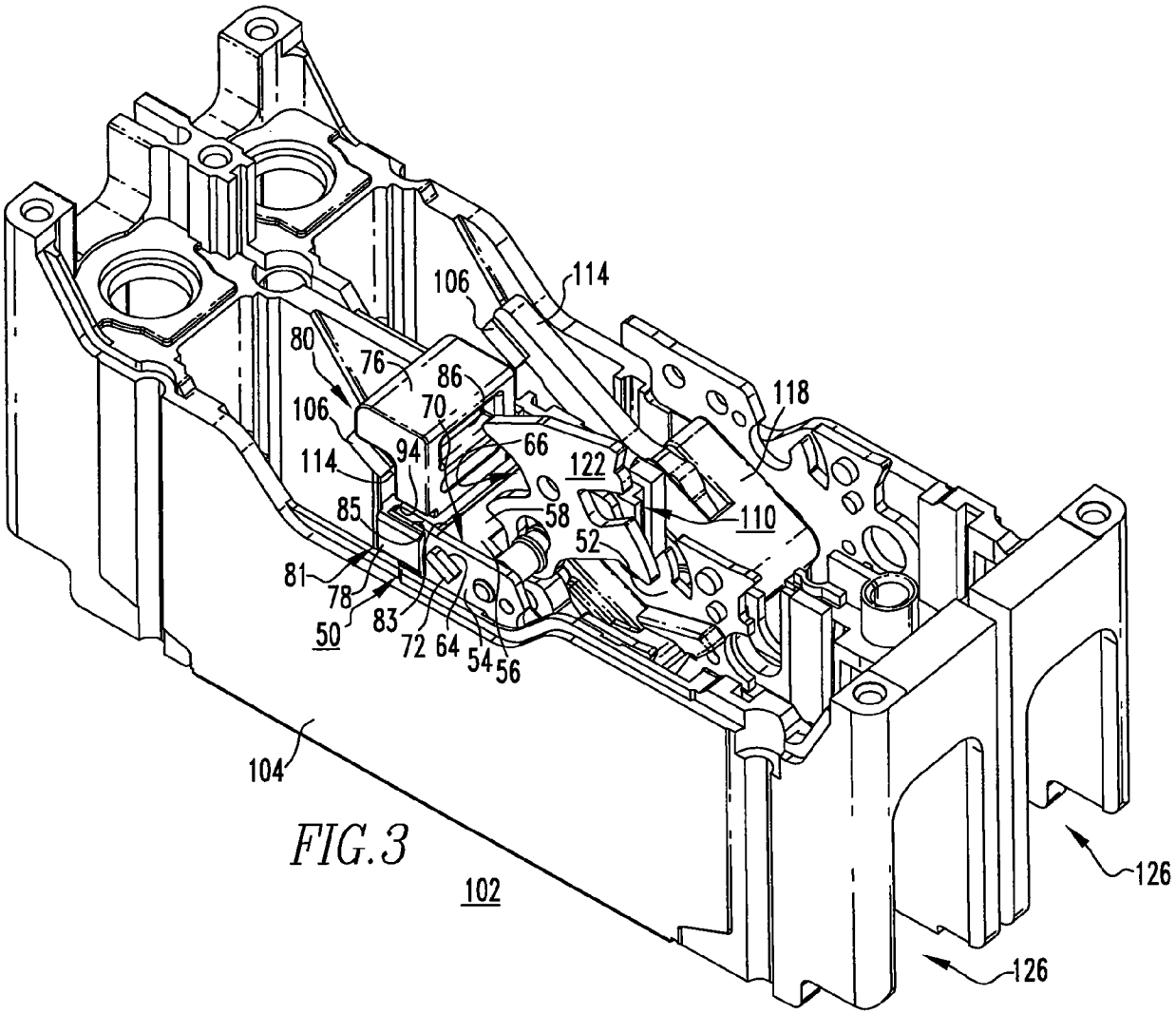
FIG. 3 is an isometric view of a portion of the circuit breaker of FIG. 2, showing the back side of a portion of the circuit breaker contact assembly, and operating mechanism and one cradle stop assembly therefor.

FIG. 2 shows a circuit breaker 102 having an operating mechanism 110 with a cradle stop assembly 50. The circuit breaker 102 generally includes a housing 104, separable contacts 106,108 enclosed by the housing 104, and the operating mechanism 110 for opening and closing the separable contacts 106,108. For simplicity of illustration, one cradle stop assembly 50 will be shown and described herein. It will, however, be appreciated that any suitable number of cradle stop assemblies 50 could be employed. For example, for a multi-pole molded case circuit breaker 102, such as the one shown in FIG. 2, although one cradle stop assembly 50 is preferably employed regardless of the number of poles 126 (one pole 126 is shown in FIG. 2; two poles 126 are shown in FIG. 3) of the circuit breaker 102, it will be appreciated that separate cradle stop assemblies 50 could be employed for each pole 126 of the circuit breaker 102 without departing from the scope of the invention.

Continuing to refer to FIG. 2, it will be appreciated that the separable contacts comprise a movable contact 106, which is electrically connected to and carried by the pivotable movable contact arm 114, and a stationary contact 108.

The operating mechanism 110 may be substantially similar to that which is shown and described in U.S. Pat. No. 5,910,760 issued Jun. 8, 1999 to Malingowski et al., entitled "Circuit Breaker with Double Rate Spring." As shown in FIGS. 2-5, the operating mechanism 110 includes a cradle member 122 movable between a latched position (shown), corresponding to the separable contacts 106,108 being closable, and an unlatched position (not shown), corresponding to the separable contacts 106,108 being tripped open, for example, in response to an electrical fault condition (e.g., without limitation, and overcurrent condition, and overload condition, an undervoltage condition, or a relatively high level short circuit or fault condition). Each pole 126 (FIGS. 2 and 3) of the circuit breaker 102 includes one pivotable movable contact arm 114 which is pivotably coupled to a crossbar 118 of the operating mechanism 110. A portion of the cradle stop assembly 50 is also structured to be coupled to the crossbar 118 of the operating mechanism 110, as will be discussed hereinbelow.

Figure 5:
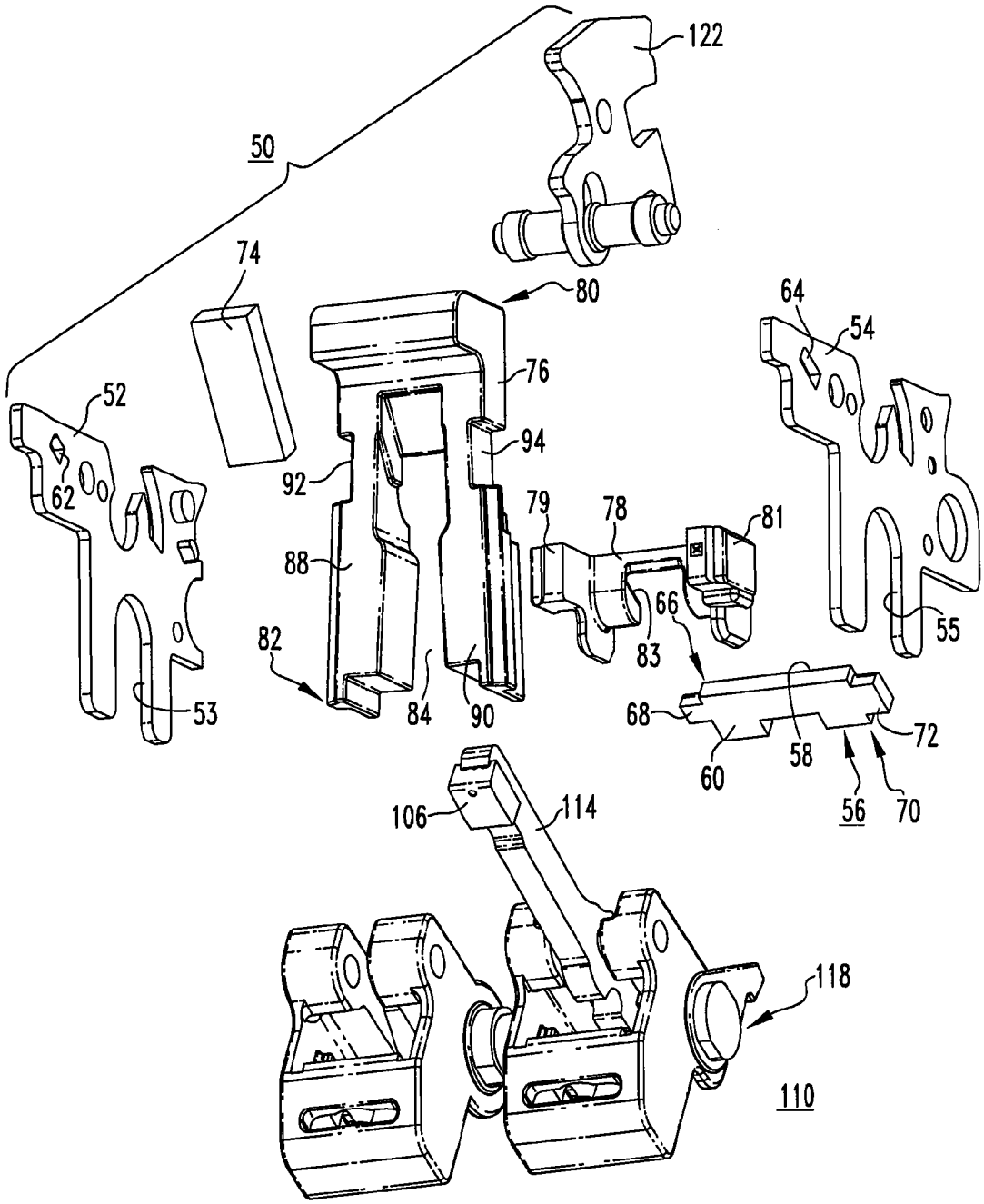
FIG. 5 is an exploded isometric view of a portion of the circuit breaker contact assembly and cradle stop assembly therefor of FIG. 4.

As best shown in the exploded view of FIG. 5, the cradle stop assembly 50 includes a first member 52 structured to be coupled to a portion (e.g., crossbar 118) of the operating mechanism 110, a second member 54 disposed opposite the first member 52 and also being structured to be coupled to a portion (e.g., crossbar 118) of the operating mechanism 110, and a stop plate 56 extending between the first and second members 52,54 and including a first stop portion 58 and a second stop portion 60 disposed generally opposite the first stop portion 58. The example stop plate 56 is substantially flat with the first stop portion 58 comprising the first side of the stop plate 56 and the second stop portion 60 comprising the second side of the stop plate 56, although it will be appreciated that any suitable stop plate shape which is generally planar in nature (e.g., without limitation, a plate member including ribs, bends or any other suitable structure, for example, for increasing the strength of the stop plate) could be employed.

The first side or stop portion 58 of the stop plate 56 is structured to resist movement of the cradle member 122 of the operating mechanism 110 beyond a first predetermined position, which is shown in FIG. 2, thereby avoiding the cradle member 122 undesirably interfering with the pivotable movable contact arm 114 of the operating mechanism 110. The second side or stop portion 60 of the stop plate 56 is structured to resist the pivotable movable contact arm 114 from undesirably pivoting beyond a second predetermined position, also shown in FIG. 2.

Continuing to refer to FIG. 5 and also referring back to FIGS. 2-4, which respectively show some but not all of the following components of the cradle stop assembly 50, it will be appreciated that the first and second members 52,54 of the cradle stop assembly 50 each comprise generally planar members 52,54 having a number of apertures 62,64 (best shown in FIG. 5). The stop plate 56 includes a first end 66 having at least one first protrusion 68 and a second end 70 having at least one second protrusion 72, wherein each first protrusion 68 of the first end 66 engages a corresponding one of the apertures 62 of the first generally planar member 52 and each second protrusion 72 of the second end 70 engages a corresponding aperture 64 of the second generally planar member 54. In this manner, the stop plate 56 is secured between the first and second members 52,54 of the cradle stop assembly 50. More specifically, the first and second members 52,54 of the example cradle stop assembly 50 comprise first and second apertures 62,64 disposed in the first and second members 52,54, and the first and second protrusions 68,72 of the first and second ends 66,70 of the stop plate 56 comprise first and second tabs 68,72 which engage the first and second apertures 62,64 of the first and second members 52,54, respectively. It will, however, be appreciated that any known or suitable fastening or securing mechanism and/or configuration could be alternatively employed to secure the stop plate 56 in the desired position with respect to the pivotable movable contact arm 114 and cradle member 122 of the circuit breaker operating mechanism 110.

Figure 4:
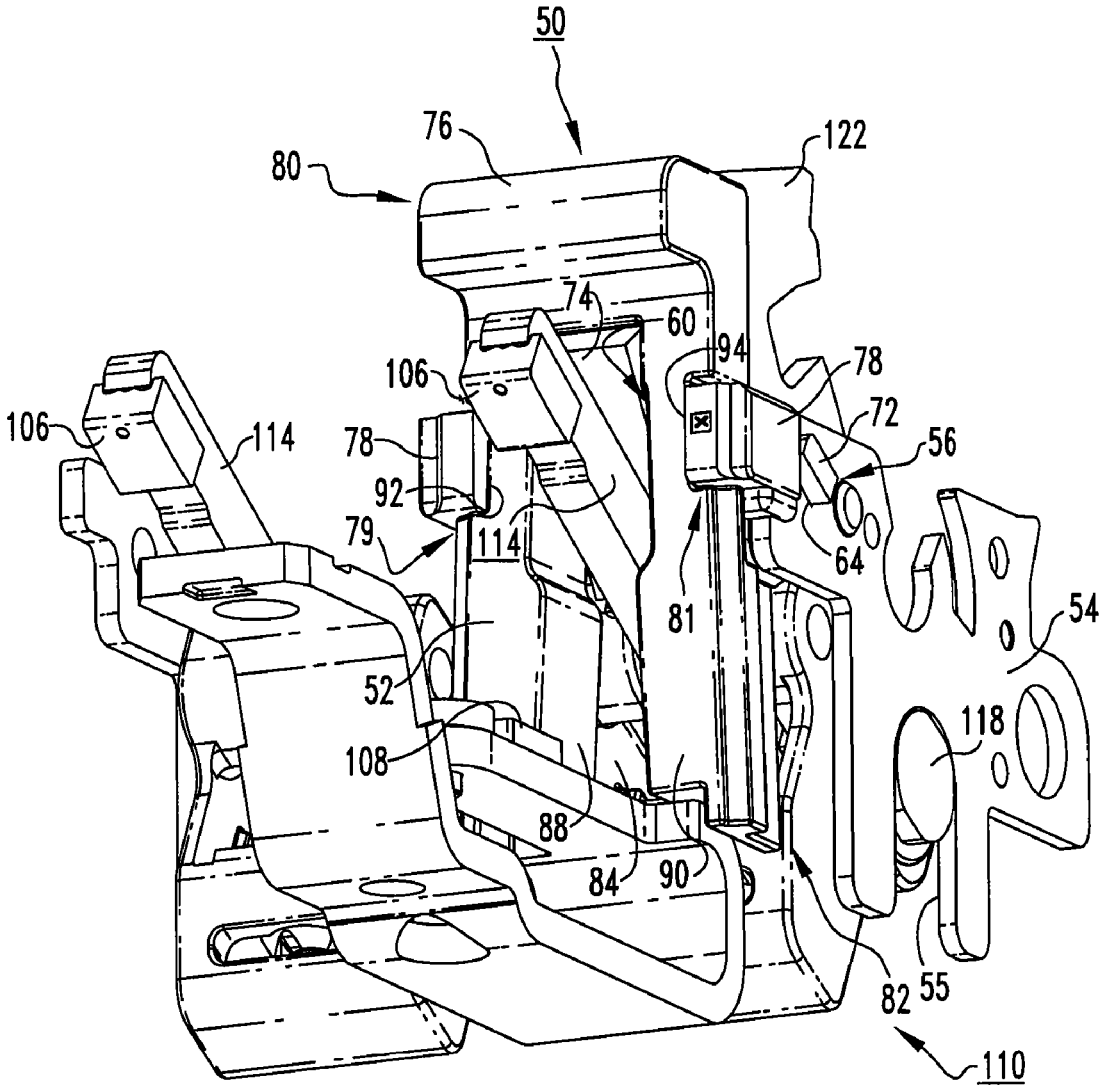
FIG. 4 is an isometric view of the portion of the circuit breaker contact assembly, and operating mechanism and cradle stop assembly therefor of FIG. 3.

As best shown in FIGS. 2, 4 and 5, the pivotable movable contact arm 114 of the operating mechanism 110 of the circuit breaker 102 is movable among a closed position (not shown, but see, for example, the closed position of movable contact arm 14 of FIG. 1, shown in phantom line drawing), and an open position (shown) corresponding to the separable contacts 106,108 (FIGS. 2 and 4) being separated. When the pivotable movable contact arm 114 is disposed in the open position, it is spaced from the stop plate 56 in order to form a gap 124 between the stop plate 56 and pivotable movable contact arm 114, as shown in FIG. 2. As one non-limiting example, the gap 124 is about 0.125 inch. The second stop portion 60 of stop plate 56 of the example cradle stop assembly 50 preferably further includes a resilient bumper 74 which is disposed within this gap 124. Accordingly, the gap 124 and the resilient bumper 74 disposed therein serve to absorb the impact, if any, of the pivotable movable contact arm 114 as it pivots clockwise (with respect to FIG. 2) in the direction indicated by arrow 128 to the position shown in FIG. 2. In this manner, the resilient bumper 74 serves not only to resist damage to the pivotable movable contact arm 114 and/or the stop plate 56 which could otherwise result as a consequence of such impact, but also to absorb such impact and dissipate the associated energy of the pivotable movable contact arm 114, in order to minimize the chance of the pivotable movable contact arm 114 undesirably rebounding and unintentionally bringing the movable contact 106 back into electrical contact with stationary contact 108. Thus, the example stop plate 56 simultaneously serves two important functions: (a) it stops the cradle member 122 of the operating mechanism 110 from rotating counterclockwise (from the perspective of FIG. 2) in the direction indicated by arrow 130 beyond the position shown in FIG. 2, and thus undesirably interfering with, for example, the pivotable movable contact arm 114 of the operating mechanism 110, and (b) it prevents over-rotation of the pivotable movable contact arm 114 in the clockwise direction (from the perspective of FIG. 2) in the direction of arrow 128, as previously discussed.

As best shown in FIGS. 3-5, the example cradle stop assembly 50 further includes a barrier member 76 and a coupling member 78. The barrier member 76 is disposed between the cradle member 122 of the operating mechanism 110 and the separable contacts 106,108 (FIG. 4) of the circuit breaker 102 (FIG. 2), and between the separable contacts 106,108 (FIG. 4) and the stop plate 56. Accordingly, the barrier member 76 functions, at least in part, to electrically insulate the cradle member 122 and the stop plate 56 from the separable contacts 106,108 (FIG. 4) in order to resist undesirable arcing therebetween. The coupling member 78 couples the barrier member 76 to the first and second members 52,54 of the cradle stop assembly 50.

More specifically, the barrier member 76 includes a first end 80 disposed proximate the stop plate 56, a second end 82 disposed distal from the first end 80, and an elongated slot 84 extending from the second end 82 of the barrier member 76 and structured to receive the pivotable movable contact arm 114 of the operating mechanism 110 therethrough, as best shown in FIG. 4. As best shown in FIG. 3, the back side of the first end 80 of the barrier member 76 includes an opening 86, which is structured to receive a portion of the cradle member 122 of the operating mechanism 110, as necessary, in order to avoid the cradle member 122 undesirably interfering with the barrier member 76. It will, however, be appreciated that in other embodiments of the invention (not shown), such opening 86 is neither necessary, nor required.

As shown in FIGS. 4 and 5, the example barrier member 76 is a generally inverted U-shaped member 76 having a first leg 88 disposed at or about the first member 52 of the cradle stop assembly 50, and a second leg 90 disposed at or about the second member 54 of the cradle stop assembly 50. The elongated slot 84 of the barrier member 76 is disposed between the first and second legs 88,90. The coupling member 78 includes a first side 79 coupled to the first member 52 of the cradle stop assembly 50 and a second side 81 coupled to the second member 54 of the cradle stop assembly 50. First and second recesses 92,94 in the first and second legs 88,90 of the generally inverted U-shaped barrier member 76 receive the first and second sides 79,81 of the coupling member 78, respectively, in order that the barrier member 76 and elongated slot 84 thereof are disposed between the first and second sides 79,81 of the coupling member 78, as shown in FIG. 4.

Returning briefly to FIG. 3, it will be appreciated that although the sides (e.g., second side 81) of the coupling member 78 in the example shown and described herein, are coupled to the members (e.g., second member 54) of the cradle stop assembly 50 by way of the side 81 of the coupling member 78 sliding over the end of the member 54 and receiving such end within a cavity 85 of the coupling member 78, as shown, any known or suitable alternative coupling or securing mechanism could be employed to secure the various components of the cradle stop assembly 50, with respect to the operating mechanism 110, without departing from the scope of the invention. It will also be appreciated that while the example coupling member 78 is contemplated as including a support portion 83 which is disposed between the first and second sides 79,81 of the coupling member 78 and which is structured to be positioned at or about the stop plate 56 of the cradle stop assembly 50 in order to support the stop plate 56, that such support portion 83 is not expressly required by the invention.

Accordingly, the disclosed cradle stop assembly 50 is employed by the operating mechanism 110 of electrical switching apparatus (e.g., without limitation, circuit breaker 102 of FIG. 2). The cradle stop assembly 50 is coupled to the operating mechanism 110 by way of first and second apertures 53,55 of the first and second members 52,54 of the cradle stop assembly 50, shown in FIG. 5, which slide over and engage the crossbar 118 of the operating mechanism 110 (see also aperture 55 of second member 54 engaging crossbar 118 in FIG. 4). It will, however, be appreciated that any suitable alternative configuration or mechanism for securing the position of the cradle stop assembly 50 with respect to the operating mechanism 110 could be employed. As previously discussed, the cradle stop assembly 50 simultaneously resists undesired movement of the cradle member 122 of the operating mechanism 110, and provides a stop (e.g., through resilient bumper 74) for preventing over rotation of the pivotable movable contact arm 114 of the operating mechanism 110 and preferably dissipating any undesired excess energy of the arm 114. The resilient bumper 74 can be made from any known or suitable resilient material such as, for example and without limitation, rubber.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A cradle stop assembly for an electrical switching apparatus, said electrical switching apparatus including a housing, separable contacts enclosed by said housing, and an operating mechanism for opening and closing said separable contacts, said operating mechanism including a pivotable movable contact arm, and a cradle member, said cradle member being movable between a latched position corresponding to said separable contacts being closeable and an unlatched position corresponding to said separable contacts being tripped open, said cradle stop assembly comprising:

a first member structured to be coupled to a portion of said operating mechanism of said electrical switching apparatus;

a second member disposed opposite said first member; and a stop plate extending between said first member and said second member, said stop plate being generally planar, said stop plate including a first stop portion and a second stop portion disposed generally opposite said first stop portion, wherein said first stop portion of said stop plate is structured to resist movement of said cradle member beyond a first predetermined position, in order to avoid said cradle member undesirably interfering with said pivotable movable contact arm of said operating mechanism, and wherein said second stop portion of said stop plate is structured to resist said pivotable movable contact arm of said operating mechanism from undesirably pivoting beyond a second predetermined position.

2. The cradle stop assembly of claim 1 wherein said operating mechanism further includes a crossbar; wherein said pivotable movable contact arm is pivotably coupled to said crossbar; and wherein at least said first member of said cradle stop assembly is structured to be coupled to said crossbar of said operating mechanism.

3. The cradle stop assembly of claim 1 wherein said first member and said second member each comprise a generally planar member including a number of apertures; wherein said stop plate includes a first end having at least one first protrusion and a second end having at least one second protrusion; wherein said at least one first protrusion of the first end of said stop plate engages a corresponding one of said apertures of said first generally planar member; and wherein said at least one second protrusion of the second end of said stop plate engages a corresponding one of said apertures of said second generally planar member.

4. The cradle stop assembly of claim 3 wherein said apertures of said first generally planar member and said second generally planar member comprise a first aperture being disposed in said first generally planar member and a second aperture being disposed in said second generally planar member; wherein said at least one first protrusion of the first end of said stop plate is a first tab; where said at least one second protrusion of the second end of said stop plate is a second tab; and wherein said first tab and said second tab engage said first aperture of said first generally planar member and said second aperture of said second generally planar member, respectively.

5. The cradle stop assembly of claim 1 wherein said second stop portion of said stop plate further comprises a resilient bumper; wherein said pivotable movable contact arm of said operating mechanism of said electrical switching apparatus is movable among a closed position corresponding to said separable contacts of said electrical switching apparatus being closed, and an open position corresponding to said separable contacts being separated; wherein when said pivotable movable contact arm is disposed in said open position, said pivotable movable contact arm is spaced from said stop plate in order to form a gap therebetween; and wherein said resilient bumper is disposed within said gap.

6. The cradle stop assembly of claim 5 wherein said gap is about 0.125 inch.

7. An operating mechanism for an electrical switching apparatus including a housing and separable contacts enclosed by said housing, said operating mechanism comprising:

at least one pivotable movable contact arm carrying at least one of said separable contacts;

a cradle member movable between a latched position corresponding to said separable contacts being closeable and an unlatched position corresponding to said separable contacts being tripped open; and a cradle stop assembly comprising:

a first member coupled to a portion of said operating mechanism, a second member disposed opposite said first member, a stop plate extending between said first member and said second member, said stop plate being generally planar, said stop plate including a first stop portion and a second stop portion disposed generally opposite said first stop portion, wherein said first stop portion of said stop plate resists movement of said cradle member beyond a first predetermined position, in order to avoid said cradle member undesirably interfering with said at least one pivotable movable contact arm of said operating mechanism, and wherein said second stop portion of said stop plate resists said at least one pivotable movable contact arm of said operating mechanism from undesirably pivoting beyond a second predetermined position.

8. The operating mechanism of claim 7 wherein said operating mechanism further includes a crossbar; wherein said at least one pivotable movable contact arm is pivotably coupled to said crossbar; and wherein said first member of said cradle stop assembly and said second member of said cradle stop assembly are structured to be coupled to said crossbar of said operating mechanism.

9. The operating mechanism of claim 7 wherein said first member of said cradle stop assembly and said second member of said cradle stop assembly each comprise a generally planar member including a number of apertures; wherein said stop plate of said cradle stop assembly includes a first end having at least one first protrusion and a second end having at least one second protrusion; wherein said at least one first protrusion of the first end of said stop plate engages a corresponding one of said apertures of said first generally planar member; and wherein said at least one second protrusion of the second end of said stop plate engages a corresponding one of said apertures of said second generally planar member.

10. The operating mechanism of claim 9 wherein said apertures of said first generally planar member and said second generally planar member comprise a first aperture being disposed in said first generally planar member and a second aperture being disposed in said second generally planar member; wherein said at least one first protrusion of the first end of said stop plate is a first tab; where said at least one second protrusion of the second end of said stop plate is a second tab; and wherein said first tab and said second tab engage said first aperture of said first generally planar member and said second aperture of said second generally planar member, respectively.

11. The operating mechanism of claim 7 wherein said cradle stop assembly further comprises a barrier member and a coupling member; wherein said barrier member comprises a first end disposed proximate said stop plate, a second end disposed distal from the first end, and an elongated slot extending from the second end of said barrier member and structured to receive said pivotable movable contact arm of said operating mechanism; wherein said barrier member is disposed between said cradle member of said operating mechanism and said separable contacts of said electrical switching apparatus; and wherein said coupling member couples said barrier member to said first member of said cradle stop assembly and said second member of said cradle stop assembly.

12. The operating mechanism of claim 11 wherein the first end of said barrier member further comprises an opening structured to receive a portion of said cradle member of said operating mechanism in order that said cradle member does not undesirably interfere with said barrier member.

13. The operating mechanism of claim 11 wherein said barrier member is a generally inverted U-shaped member having a first leg disposed at or about said first member of said cradle stop assembly and a second leg disposed at or about said second member of said cradle stop assembly; wherein said elongated slot of said barrier member is disposed between said first leg and said second leg of said generally inverted U-shaped member; wherein said coupling member includes a first side coupled to said first member of said cradle stop assembly and a second side coupled to said second member of said cradle stop assembly; wherein said first leg and said second leg of said generally inverted U-shaped member further comprise a first recess and a second recess, respectively; and wherein said first recess of said first leg of said generally inverted U-shaped member receives the first side of said coupling member and said second recess of said second leg of said generally inverted U-shaped member receives the second side of said coupling member, in order that said barrier member and said elongated slot thereof are disposed between said first side of said coupling member and the second side of said coupling member.

14. The operating mechanism of claim 11 wherein said cradle stop assembly further comprises a resilient bumper coupled within said elongated slot of said barrier member proximate the first end of said barrier member.

15. The operating mechanism of claim 11 wherein said coupling member comprises a first side coupled to said first member of said cradle stop assembly, a second side coupled to said second member of said cradle stop assembly, and a support portion disposed between said first side of said coupling member and said second side of said coupling member; and wherein said support portion of said coupling member is disposed at or about said stop plate of said cradle stop assembly.

16. An electrical switching apparatus comprising:

a housing;

separable contacts enclosed by said housing; and an operating mechanism for opening and closing said separable contacts, said operating mechanism comprising:

at least one pivotable movable contact arm carrying at least one of said separable contacts, at least one cradle member movable between a latched position corresponding to said separable contacts being closeable and an unlatched position corresponding to said separable contacts being tripped open in response to an electrical fault, and at least one cradle stop assembly comprising:

a first member coupled to a portion of said operating mechanism, a second member disposed opposite said first member, a stop plate extending between said first member and said second member, said stop plate being generally planar, said stop plate including a first stop portion and a second stop portion disposed generally opposite said first stop portion, wherein said first stop portion of said stop plate resists movement of said cradle member beyond a first predetermined position, in order to avoid said cradle member undesirably interfering with said at least one pivotable movable contact arm of said operating mechanism, and wherein said second stop portion of said stop plate resists said at least one pivotable movable contact arm of said operating mechanism from undesirably pivoting beyond a second predetermined position.

17. The electrical switching apparatus of claim 16 wherein said first member of said at least one cradle stop assembly and said second member of said at least one cradle stop assembly each comprise a generally planar member including a number of apertures; wherein said stop plate of said at least one cradle stop assembly includes a first end having at least one first protrusion and a second end having at least one second protrusion; wherein said at least one first protrusion of the first end of said stop plate engages a corresponding one of said apertures of said first generally planar member; and wherein said at least one second protrusion of the second end of said stop plate engages a corresponding one of said apertures of said second generally planar member.

18. The electrical switching apparatus of claim 16 wherein said at least one cradle stop assembly further comprises a barrier member and a coupling member; wherein said barrier member comprises a first end disposed proximate said stop plate of said at least one cradle stop assembly, a second end disposed distal from the first end, and an elongated slot extending from the second end of said barrier member for receiving a corresponding one of said at least one pivotable movable contact arm of said operating mechanism; wherein said barrier member is disposed between said at least one cradle member of said operating mechanism and said separable contacts of said electrical switching apparatus; and wherein said coupling member couples said barrier member to said first member of said at least one cradle stop assembly and said second member of said at least one cradle stop assembly.

19. The electrical switching apparatus of claim 18 wherein said barrier member is a generally inverted U-shaped member having a first leg disposed at or about said first member of said at least one cradle stop assembly and a second leg disposed at or about said second member of said at least one cradle stop assembly; wherein said elongated slot is disposed between said first leg of said generally inverted U-shaped member and said second leg of said generally inverted U-shaped member; wherein said coupling member includes a first side coupled to said first member of said at least one cradle stop assembly and a second side coupled to said second member of said at least one cradle stop assembly; wherein said first leg and said second leg of said generally inverted U-shaped member further comprise a first recess and a second recess, respectively; and wherein said first recess of said first leg of said generally inverted U-shaped member receives the first side of said coupling member and said second recess of said second leg of said generally inverted U-shaped member receives the second side of said coupling member, in order that said barrier member and said elongated slot thereof are disposed between said first side of said coupling member and the second side of said coupling member.

20. The electrical switching apparatus of claim 16 wherein said second stop portion of said stop plate of said at least one cradle stop assembly further comprises a resilient bumper; wherein said at least one pivotable movable contact arm of said operating mechanism is movable among a closed position corresponding to said separable contacts of said electrical switching apparatus being closed, and an open position corresponding to said separable contacts being separated; wherein when said at least one pivotable movable contact arm is disposed in said open position, said at least one pivotable movable contact arm is spaced from said stop plate of said at least one cradle stop assembly in order to form a gap therebetween; and wherein said resilient bumper is disposed within said gap.

21. The electrical switching apparatus of claim 16 wherein said electrical switching apparatus is a circuit breaker including a plurality of poles; wherein said at least one pivotable movable contact arm comprises a plurality of pivotable movable contact arms for the poles of said circuit breaker; and wherein said at least one cradle stop assembly comprises a plurality of cradle stop assemblies for resisting undesired movement of said at least one cradle member of said operating mechanism of said circuit breaker, and for resisting undesired movement of said pivotable movable contact arms of said operating mechanism.

* * * * *